United States Patent [19]

Magourou

[11] Patent Number: 4,640,568

[45] Date of Patent: Feb. 3, 1987

[54] ELECTRIC CABLE CONNECTOR HANDLE

[75] Inventor: Yves L. Magourou, Ermont, France

[73] Assignee: Societe de Exploitation des Procedes Marechal, Paris, France

[21] Appl. No.: 689,791

[22] Filed: Jan. 8, 1985

[30] Foreign Application Priority Data

Sep. 24, 1984 [EP] European Pat. Off. ..... 84401902.6

[51] Int. Cl.[4] ..... H01R 13/58

[52] U.S. Cl. ..... 339/103 R

[58] Field of Search ..... 339/103 R, 103 M, 105, 339/107, 101, 108 R

[56] References Cited

U.S. PATENT DOCUMENTS

| | | | |
|---|---|---|---|
| 3,430,187 | 2/1969 | De Man et al. | 339/103 R |
| 3,796,504 | 3/1974 | Marechal | 403/288 |
| 4,053,198 | 10/1977 | Doyle et al. | 339/107 X |
| 4,150,250 | 4/1979 | Lundeberg | 339/107 X |
| 4,390,227 | 6/1983 | Deutsch | 339/103 C |

FOREIGN PATENT DOCUMENTS

| | | | |
|---|---|---|---|
| 1978260 | 11/1967 | Fed. Rep. of Germany . | |
| 1489532 | 4/1969 | Fed. Rep. of Germany . | |
| 2211119 | 9/1972 | Fed. Rep. of Germany . | |
| 914625 | 10/1946 | France . | |
| 2140719 | 3/1971 | France . | |
| 2082828 | 12/1971 | France | 339/103 M |
| 2309054 | 4/1975 | France . | |
| 2328894 | 5/1977 | France . | |

*Primary Examiner*—Eugene F. Desmond

*Attorney, Agent, or Firm*—Sandler & Greenblum

[57] ABSTRACT

Electric cable connector handle for securing and providing electrical contact for a cable which enters one end of the connector handle. The connector handle comprises a gripping element comprising an annular base provided with a plurality of elastically deformable jaws which project from the annular base and cooperate with at least one frustoconic bearing. The gripping element is positioned in the connector handle in a manner such that at least the exterior portions of the ends of the jaws converge opposite to the annular base and are disposed on the side of the base opposite to the inlet of the cable into the connector handle. The frustoconic bearing converges towards the longitudinal axis of the handle on the opposite side of the base relative to the inlet of the cable. The connector handle also comprises means for exerting a pressure on the annular base to immobilize it in the connector handle and cause an axial displacement of the base and of the jaws into the frustoconic bearing to cause the jaws to grip the cable.

18 Claims, 4 Drawing Figures

ELECTRIC CABLE CONNECTOR HANDLE

BACKGROUND OF THE INVENTION

1. Field of the Invention

The present invention relates to a fastening system for securing an electric cable or the like to the handle of a connector or the like.

2. Description of Background and Pertinent Materials

Amongst the numerous apparatus for securing electric cables to plugs and handles, particular apparatus are described in French Pat. Nos. 2,140,719 (corresponding to the U.S. Pat. No. 3,796,504) and 2,309,054 in the name of the assignee of the present application. These patents describe apparatus comprising a clamping apparatus formed of an annular base which is fixed in position and which is provided with a plurality of jaws or clamps provided in a manner so as to cooperate by elastic deformation with at least one frustoconic bearing.

In these apparatus the base rests, generally with the interposition of a sealing joint, on a bearing of the handle and the jaws extend up above the base. A frustoconic bearing is provided in a cap in a manner so as ensure that the attachment of the cap on the handle tightens the jaws on the cable.

In these apparatus, the joint assures a seal between the base and the handle while nevertheless pressing, by virtue of a special configuration against the cable. However, the jaws remain vulnerable to accidental harm and particularly to freezing because they are positioned above the seal and are turned upwardly towards the cap.

The assembly and the guidance of the jaws furthermore remains delicate and their grip on the cable is often insufficient.

SUMMARY OF THE INVENTION

The invention is directed to an electric cable connector handle for securing and providing electrical contact for a cable which enters one end of the connector handle. The connector handle according to the invention includes:

(a) a gripping element comprising an annular base provided with a plurality of elastically deformable jaws which project from the annular base and cooperate with at least one frustoconic bearing. The gripping element is positioned in the connector handle in a manner such that at least the exterior portions.of the ends of the jaws converge opposite to the annular base and are disposed on the side of the base opposite to the inlet of the cable into the connector handle. The frustoconic bearing converges towards the longitudinal axis thereof on the opposite side of the base relative to the inlet of the cable.

(b) Means for exerting pressure on the annular base to immobilize it in the connector handle and cause an axial displacement of the base and of the jaws into the frustoconic bearing to cause the jaws to grip the cable.

According to one particular embodiment of the invention, the electric cable connector further comprises a seal between the annular base and a cover which is centrally bored to permit the passage of the cable. The peripheral portion of the seal is in contact with the internal wall of the connector handle. The seal joint comprises a peripheral rib adapted to contact the internal wall of the connector handle.

The cover itself may comprise at least one projection adapted to force fit and nest in at least one corresponding opening provided in the base to secure the cover. The seal is provided with openings traversed in a sealed manner by the projections.

Alternatively, or additionally, the annular base, rather than the cover, comprises at least one projection adapted to force fit and nest in a corresponding opening provided in the cover to immobilize the cover relative to the annular base. The seal has openings traversed in a sealed manner by the at least one projection.

Rathet than using the above projections, the cover and annular base may each comprise openings for the passage of at least one attachment screw secured in at least one tapped opening provided in the interior of the connector handle. The seal includes at least one opening positioned and adapted to assure a seal for the screw passage.

In addition to the cover, a cap may be provided which is adapted to be screwed onto the handle in a manner whereby the complete screw-on of the cap on the handle exerts downward pressure directly on the cover which is transmitted to the base in the course of the cap being screwed. This forces the jaws into the frustoconic bearing.

Alternatively, the cap adapted to be screwed onto the handle, contacts the annular base before the complete screw-on of the cap on the handle in a manner such that the cap exerts a pressure directly on the base in the course of its being screwed on whereby said jaws are forced further into the frustoconic bearing.

The frustoconic bearing may be divided into as many frustoconical sectors as the base has jaws, each sector being defined laterally by walls parallel to the longitudinal axis of the handle in a manner so as to position and guide the jaws.

In an alternative embodiment the frustoconic bearing is replaced by at least one inclined plane, each of the inclined planes coverging towards the longitudinal axis of the handle on the side opposite to the inlet of the cable. Each plane is laterally defined by walls which are parallel to the longitudinal axis in a manner so as to position and guide the jaws. The gripping element is positioned in the connector handle in a manner such that at least the exterior portions of the ends of said jaws converge opposite to the annular base and are disposed on the side of the base opposite to the inlet of the cable into the connector handle. Again, means are provided for exerting a pressure on the annular base to immobilize it in the connector handle and cause an axial displacement of the base and of the jaws into the inclined planes to cause the jaws to grip the cable.

BRIEF DESCRIPTION OF DRAWINGS

The invention will now be described with reference to the annexed drawings and description given by way of example only in which.

DESCRIPTION OF PREFERRED EMBODIMENTS

Figure 1:
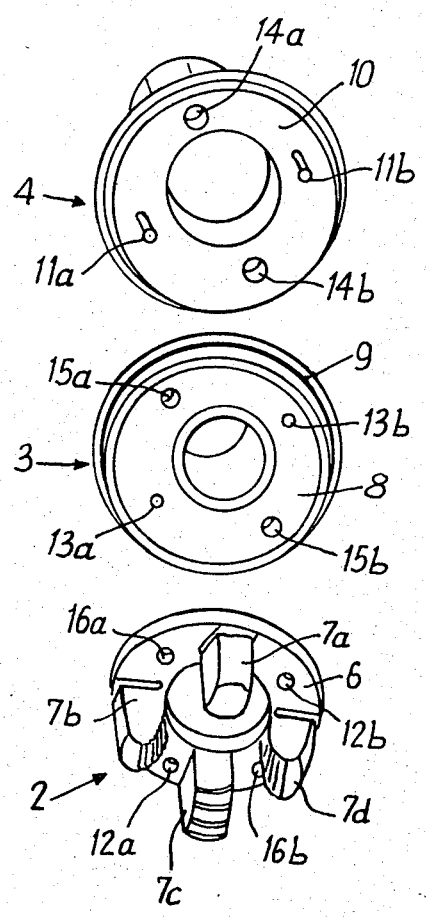
FIG. 1 illustrates a perspective view of three elements of a device according to the invention in their relative assembly positions.

So as to facilitate the assembly of the various elements, improve the grip of the jaws and assure a better protection thereof, the invention proposes an apparatus which comprises, in a known manner, a gripping element which is formed of an annular base provided with a plurality of jaws which project from the base and which are adapted so as to cooperate by elastic deformation with at least one frustoconic bearing. The device according to the invention is remarkable in that the gripping element is positioned in the handle in a manner such that the jaws of which at least one of the exterior portions of the ends converge opposite to the base, are disposed with respect to the base on the side opposite to the inlet of the cable into the handle. A frustoconic bearing is provided in the handle and converges towards the longitudinal axis thereof on the side opposite to the inlet of the cable. Means are provided to exert a pressure on the base and immobilize it in the handle such that this pressure causes an axial displacement of the base and of the jaws and thus a tight pressing of the jaws against the interior of the frustoconic bearing.

In the apparatus according to the invention, as opposed to apparatus which were previously known and mentioned above, the jaws are cut back, the base no longer rests in a fixed manner on a bearing of the handle, and the frustoconic bearing acting on the jaws is no longer in a moveable cap but in the handle itself, such that the movement causing the tightening of the jaws is no longer that of the bearing with respect to jaws in fixed axial position, but that of axially moveable jaws with respect to a fixed bearing.

It may be observed that in U.S. Pat. No. 3,796,504, that the resistance to pull on the cable when the cable is tensioned is the result of a force directed towards the point of convergence of the jaws when the cap is tightened, while according to the invention, the resistance force is directed opposite to, or away from the convergence point.

According to one embodiment provided with a seal joint, the seal joint is provided between the base of the gripping element and a cover which is centrally bored to allow the cable to pass therethrough. The peripheral portion of the joint contacts the internal wall of the handle.

Preferably, in this case, the joint is provided with a peripheral rib adapted to contact the internal wall of the handle.

It is clear thus that with a simple form of joint, the joint nevertheless makes it possible to assure a complete seal, with the jaws themselves being protected by the seal.

To facilitate the assembly and positioning of the elements, the cover or base of the gripping element is provided with projections adapted to nest or force fit under pressure in corresponding openings provided in the base or, respectively, the cover, in a manner to secure and immobilize the cover, the gripping element and the joint to one another. The joint is provided with an opening traversed in a sealed manner by the projections.

According to one embodiment, the cover, the base of the gripping element and the joint are provided with openings for the passage of attachment screws which come into tapped openings provided on the interior of the handle, the openings of the joint being adjusted so as to assure a seal of the screw passage.

According to another embodiment which is provided with a cap adapted to be screwed onto the handle, the cap and the base of the gripping element or respectively the cover have portions which come into contact before the complete tightening of the cap on the handle in a manner such that the cap exerts a direct pressure on the base or respectively the cover in the course of its being screwed on.

Preferably, the frustoconic bearing of the handle is divided into as many frustoconic sectors as the base has jaws, each sector being laterally defined by walls parallel to the longitudinal axis of the handle in a manner so as to position and guide the jaws.

The frustoconic sectors mentioned above can of course be replaced by simple inclined planes.

Figure 2:
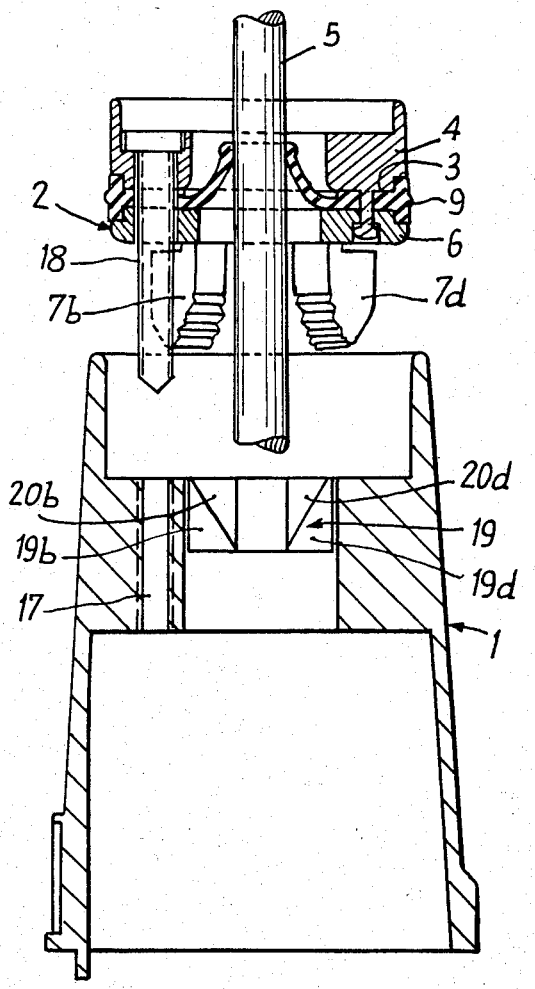
FIG. 2 is a longitudinal cross-sectional view of an assembled handle.
Figure 3:
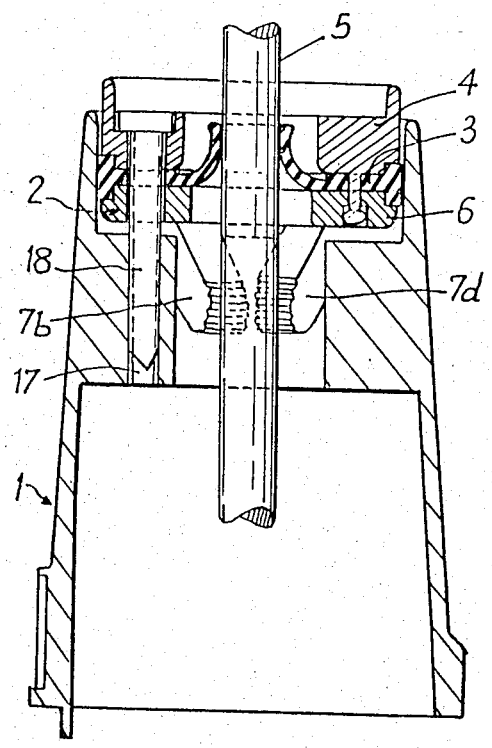
FIG. 3 is a longitudinal cross-sectional view similar to FIG. 2, the gripping apparatus being fixed within the handle.
Figure 4:
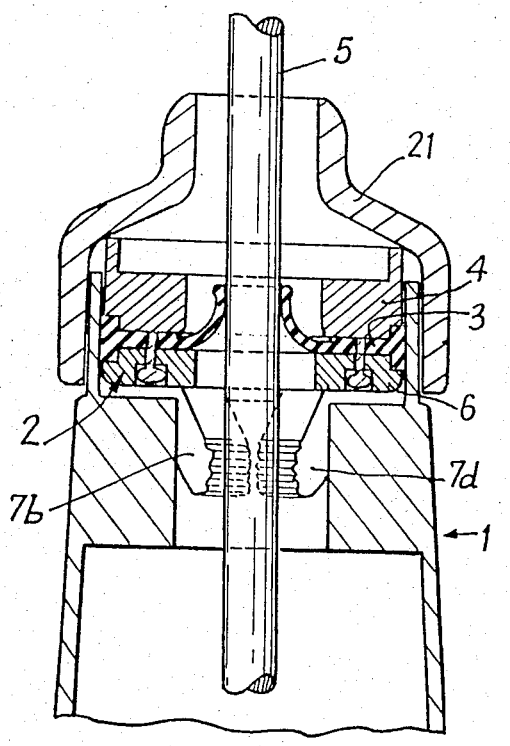
FIG. 4 is a longitudinal cross-sectional view similar to FIG. 3, according to another embodiment of the invention.

FIGS. 2–4 illustrate a handle having means 2, 3, 4 for securing a cable 5 within the handle.

The hooking apparatus, as is more particularly seen in FIG. 1, comprises a gripping element 2, a seal joint 3, and a cover 4.

Gripping element 2 comprises an annular base 6 from which four jaws *7a–7d* project which are positioned two-by-two along two radially orthogonal planes. Jaws *7a–7d* are elastically attached to base 6 of element 2 by a thin portion of material.

Joint 3 has (FIGS. 1–4) a central bored portion having, for example, a hyperbeloid of revolution configuration adapted to elastically mate with the shape of cable 5 to be gripped (FIGS. 2–4), an annular flat portion 8 and a peripheral portion provided with a rib 9 (FIGS. 1 and 2).

Cover 4 has an annular portion 10, from which two small projections 11*a*, 11*b*, project, the two projections being diametrically opposed.

Base 6 of the gripping element 2 and the annular portion 8 of joint 3 have openings respectively 12*a* and 12*b*, and 13*a* and 13*b*, positioned in the same manner as projections 11*a* and 11*b* of cover 4.

Furthermore, annular portions 10 and 8 of the cover and respectively of the joint, as well as base 6 of element 2, have diametrically opposed openings, respectively 14*a*, 14*b*, 15*a*, 15*b* and 16*a*, 16*b*, all positioned in the same manner.

Elements 2, 3 and 4 adapted to be assembled in the order shown in FIG. 1 to form an assembly which is shown in FIGS. 2–4.

For this assembly projections 11*a*, 11*b* of cover 4 traverse in a sealed manner openings 13*a*, 13*b* of joint 3 and at least a portion of the openings 12*a* and 12*b* of base 6 of element 2 in which they are force-fitted and are immobilized. Openings 12*a* and 12*b* may be provided with a small internal retention shoulder to further secure the force-fitted projections.

Figure 5:
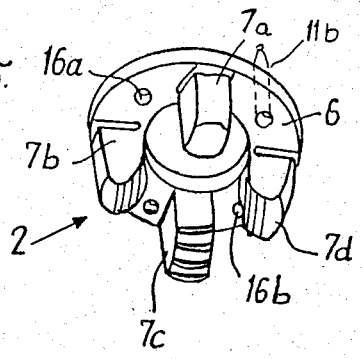
FIG. 5 is a perspective view of the gripping element according to another embodiment of the invention.

As shown in FIG. 5, projections 11*a* (not shown) and 11*b* project out of the surface of annular base 2 opposite to that on which jaws *7a–7d* are located. Projections 11*a* and 11*b* are force-fitted and immobilized in corresponding holes in seal 3 and cover 4.

After assembly, joint 3 is thus gripped between annular portion 10 of cover 4 and base 6 while openings 14*a*, 15*a* and 16*a* and respectfully 14*b*, 15*b*, and 16*b* are aligned.

FIG. 2 illustrates means 2, 3, 4, which were previously described, in a position ready to be affixed in handle 1.

Handle 1 has, as shown in FIGS. 2 and 3, tapped openings, such as shown at 17, which are adapted to receive screws, such as shown at 18.

To illustrate in greater detail, and by virtue of various planes of symmetry, the cross-section of FIGS. 2 and 3 are bent back cross sections arranged along two orthogonal lines, such that they represent a single opening 17 for a screw 18, which makes it possible to represent at the same time assembly projections of element 2, 3 and 4 (in fact there are two openings 17 which are diametrically opposed for two screws 18).

Handle 1 likewise has a frustoconical bearing 19 which is divided into four converging frustoconic sections on the opposite side of the entrance of the cable. Two of the sections can be partially seen at 19*b* and 19*d* in FIG. 2.

The frustoconic sections provided in the handle are each defined on two sides by parallel walls along the longitudinal axis of the handle. Walls 20*b* and 20*d* are seen in part in FIG. 2 (in the embodiment shown there are four sectors and eight walls).

As seen in FIGS. 2–4, means 2, 3, and 4 are positioned in handle 1 such that jaws 7*a*–7*d* are directed towards the interior of the handle.

As shown more particularly in FIG. 1, the end of each of jaws 7*a*–7*d* has a surface, turned towards the longitudinal axis of the apparatus, which is provided with grooves, ribs or teeth, while the opposite surface converges towards the central axis with respect to the plane of base 6.

The assembly of means 2, 3, and 4, and the attachment of the cable are simple to understand.

Cable 5 is passed through the bored central portions of elements 2, 3 and 4 which are assembled and positioned in a manner such as previously described, the central portion of the joint being pressed against the cable in the manner shown.

Cable 5 is, of course, connected to the various contacts (not shown) provided in the handle and the apparatus is then secured shut by means of screws 18 which go through openings 14*a*–16*a* and 14*b*–16*b* to be screwed into tapped openings 17 of the handle.

It is interesting to note in passing that openings 15*a* and 15*b* of joint 3 are adjusted in a manner such that the joint likewise assures a proper seal around each of the screws.

In the course of being screwed on, the convergence of the jaws are supported against and pressed against frustoconical sections of the handle, thus causing a tightening of the jaws which tightly grip cable 5 (FIG. 3).

The jaws are furthermore perfectly guided in the course of being screwed between the various walls 20.

FIG. 4 illustrates an embodiment where an attachment occurs by a bolt nut.

In this embodiment, means 2, 3 and 4 are identical to those shown in FIG. 1 with the exception however of openings 14*a*, 14*b*–16*a*, 16*b*. In this embodiment, handle 1 is provided with an external threading adapted to be screwed into an internal thread of a nut or cap 21.

Cap 21 is provided with an oblique internal surface adapted to come into contact with cover 4 in a manner such that screwing of the cap exerts pressure on the cover and secures elements 2, 3 and 4 to serve the function of screws 18 in the embodiment previously described.

Final attachment of means 18 or 21 secures means 2, 3, and 4, and causes lateral pressure on the jaws by surfaces 20, and the arrangement of the jaws assures a proper maintenance of cable 5 in the event of torsion or traction thereon.

Numerous modifications can obviously be provided without going beyond the scope of the invention. Thus, for example, the apparatus need not necessarily have a seal joint and a cover 7 (depending upon the intended application), in which case cap 21 of the embodiment FIG. 4 acts directly on element 2, or screws 18 of the embodiment FIG. 2 go through only openings 16*a*–16*b* to be screwed into tapped openings 17 of the handle.

Likewise, instead of having a frustoconical bearing divided into sectors, it is possible to provide a plurality of inclined planes, etc.

Finally, although the invention has been described with reference to particular means, materials and embodiments, it is to be understood that the invention is not limited to the particulars disclosed, but extends to all equivalents within the scope of the claims.

What is claimed is:

1. Electric cable connector handle for securing and providing electrical contact for a cable which enters one end of said connector handle, said connector handle comprising:

(a) a gripping element comprising an annular base provided with a plurality of elastically deformable jaws which project from the annular base and cooperate with at least one frustoconic bearing, said gripping element being positioned in the connector handle in a manner such that at least the exterior portions of the ends of said jaws converge opposite to the annular base and are disposed on the side of the base opposite to the inlet of the cable into the connector handle, and wherein said frustoconic bearing converges towards the longitudinal axis thereof on the opposite side of the base relative to the inlet of the cable;

(b) means for exerting a pressure on the annular base to immobilize it in the connector handle and cause an axial displacement of the base and of the jaws into said frustoconic bearing to cause said jaws to grip said cable, wherein said jaws are inwardly and elastically deformable, wherein when said annular base is moved along said longitudinal axis of said bearing, at least the ends said jaws are deformed into a position in which at least said jaw ends grip said cable;

(c) a seal between the annular base and a cover; and (d) means for fixedly connecting said cover, said seal and said annular base to one another.

2. The electric cable connector as defined by claim 1 wherein said cover is centrally bored to permit the passage of said cable.

3. The electric cable connector as defined by claim 2 wherein the peripheral portion of the seal is in contact with the internal wall of the connector handle.

4. The electric cable connector as defined by claim 3 wherein said seal comprises a peripheral rib adapted to contact the internal wall of the connector handle.

5. The electric cable connector as defined by claim 1 wherein said cover comprises at least one projection adapted to force fit and nest in at least one corresponding opening provided in the base to secure the cover, said seal comprising openings traversed in a sealed manner by said projections.

6. The electric cable connector as defined by claim 1 wherein said annular base comprises at least one projection adapted to force fit and nest in a corresponding opening provided in the cover to immobilize said cover relative to said annular base, said seal comprising openings traversed in a sealed manner by the at least one projection.

7. The electric cable connector as defined by claim 1 wherein said cover and said annular base each comprise openings for the passage of at least one attachment screw secured in at least one tapped opening provided in the interior of the connector handle, said seal comprising at least one opening positioned to assure a seal for the screw passage.

8. The electric cable connector as defined by claim 1 comprising a cap adapted to be screwed on the handle, said cap and said cover coming into contact before the complete screw-on of the cap on the handle in a manner whereby the cap exerts downward pressure directly on the cover which is transmitted to the base in the course of the cap being screwed on whereby said jaws are forced further into said frustoconical bearing.

9. The electric cable connector as defined by claim 1 comprising a cap adapted to be screwed onto the handle, said cap and said annular base coming into contact before the complete screw-on of the cap on the handle in a manner such that the cap exerts a pressure directly on the base in the course of its being screwed on whereby said jaws are forced further into said frustoconic bearing.

10. The electric cable connector as defined by claim 1 wherein said frustoconic bearing is divided into as many frustoconical sectors as the base has jaws, each sector being defined laterally by walls parallel to the longitudinal axis of the handle in a manner so as to position and guide the jaws.

11. Electric cable connector handle for securing and providing electrical contact for a cable which enters one end of said connector handle, said connector handle comprising:

(a) a gripping element comprising an annular base provided with a plurality of elastically deformable jaws which project from the annular base and cooperate with at least one inclined plane, each of said inclined planes converging towards the longitudinal axis of the handle on the side opposite to the inlet of the cable while each plane is laterally defined by walls which are parallel to the longitudinal axis in a manner so as to position and guide the jaws, said gripping element being positioned in the connector handle in a manner such that at least the exterior portions of the ends of said jaws converge opposite to the annular base and are disposed on the side of the base opposite to the inlet of the cable into the connector handle;

(b) means for exerting a pressure on the annular base to immobilize it in the connector handle and cause an axial displacement of the base and the jaws into said inclined planes to cause said jaws to grip said cable, wherein said jaws are inwardly and elastically deformable, wherein when said annular base is moved along said longitudinal axis of said bearing, at least the ends of said jaws are deformed into a position in which at least said jaw ends grip said cable;

(c) a seal provided between the annular base and a cover; and (d) means for fixedly connecting said cover, said seal and said annular base to one another.

12. Electric cable connector handle for securing and providing electrical contact for a cable which enters one end of said connector handle, said connector handle comprising:

(a) a gripping element comprising an annular base provided with a plurality of elastically deformable jaws which project from the annular base and cooperate with at least one frustoconic bearing, said gripping element being positioned in the connector handle in a manner such that at least the exterior portions of the ends of said jaws converge opposite to the annular base and are disposed only on the side of the base opposite to the inlet of the cable into the connector handle, and wherein said frustoconic bearing converges towards the longitudinal axis thereof on the opposite side of the base relative to the inlet of the cable;

(b) means for exerting pressure on the annular base to immobilize it in the connector handle and cause an axial displacement of the base and of the jaws into said frustoconic bearing to cause said jaws to grip said cable;

(c) a seal provided between the annular base and a cover; and (d) means for fixedly connecting said cover, said seal and said annular base to one another.

13. The electric cable connector as defined by claim 12 wherein said seal comprises a peripheral rib adapted to contact the internal wall of the connector handle and said cover comprises a central bore for receiving said cable.

14. The electric cable connector as defined by claim 13 wherein said means for exerting pressure on the annular base comprises a cap adapted to be screwed onto the handle, said cap and said cover coming into contact before the complete screw-on of the cap on the handle in a manner whereby the cap exerts downward pressure directly on the cover which is transmitted to the base in the course of the cap being screwed on whereby said jaws are forced further into said frustoconical bearing.

15. The electric cable connector as defined by claim 13 wherein said means for exerting pressure on the annular base comprises a cap adapted to be screwed onto the handle, said cap and said annular base coming into contact before the complete screw-on of the cap on the handle in a manner such that the cap exerts pressure directly on the base in the course of its being screwed on whereby said jaws are forced further into said frustoconic bearing.

16. The electric cable connector as defined by claim 13 wherein said frustoconic bearing is divided into as many frustoconical sectors as the base has jaws, each sector being defined laterally by walls parallel to the longitudinal axis of the handle in a manner so as to position and guide the jaws.

17. Electric cable connector handle for securing and providing electrical contact for a cable which enters one end of said connector handle, said connector handle comprising:

(a) a gripping element comprising an annular base provided with a plurality of elastically deformable jaws which project from the annular base and cooperate with at least one inclined plane, each of said inclined planes converging towards the longitudinal axis of the handle on the side opposite to the inlet of the cable while each plane is laterally defined by walls which are parallel to the longitudinal axis in a manner so as to position and guide the jaws, said gripping element being positioned in the connector handle in a manner such that at least the exterior portions of the ends of said jaws converge opposite to the annular base and are disposed only on the side of the base opposite to the inlet of the cable into the connector handle;

(b) means for exerting a pressure on the annular base to immobilize it in the connector handle and cause an axial displacement of the base and the jaws into said inclined planes to cause said jaws to grip said cable;

(c) a seal provided between said annular base and a cover; and (d) means for fixedly connecting said cover, said seal and said annular base to one another.

18. Electric cable connector handle for securing and providing electrical contact for a cable which enters one end of said connector handle, said connector handle comprising:

(a) a gripping element comprising an annular base provided with a plurality of elastically deformable jaws which project from the annular base and cooperate with at least one frustoconic bearing, said gripping element being positioned in the connector handle in a manner such that at least the exterior portions of the ends of said jaws converge opposite to the annular base and are disposed on the side of the base opposite to the inlet of the cable into the connector handle, and wherein said frustoconic bearings converges towards the longitudinal axis thereof on the opposite side of the base relative to the inlet of the cable;

(b) means for exerting pressure on the annular base to immobilize it in the connector handle and cause an axial displacement of the base and of the jaws into said frustoconic bearing to cause said jaws to grip said cable;

(c) a seal between the annular base and a cover, a peripheral portion of said seal being in contact with the internal wall of the connector handle, and said cover being centrally bored to permit the passage of said cable; and (d) means for fixedly connecting said cover, said seal and said annular base to one another.

* * * * *

UNITED STATES PATENT AND TRADEMARK OFFICE

CERTIFICATE OF CORRECTION

PATENT NO. : 4,640,568

DATED : February 3, 1987

INVENTOR(S) : Yves L. MAGOUROU

It is certified that error appears in the above-indentified patent and that said Letters Patent is hereby corrected as shown below:

At column 4, line 50, insert ---are--- after "4".
At column 6, line 11, delete "7".
At column 7, line 2, change "projections" to ---at least one projection--.

Signed and Sealed this

Twenty-seventh Day of September, 1994

*Attest:*

Bruce Lehman

BRUCE LEHMAN

*Attesting Officer*

*Commissioner of Patents and Trademarks*